US011459828B2

(12) United States Patent
Peters et al.

(10) Patent No.: US 11,459,828 B2
(45) Date of Patent: Oct. 4, 2022

(54) DRILLING APPARATUS USING A SELF-ADJUSTING DEFLECTION DEVICE AND DEFLECTION SENSORS FOR DRILLING DIRECTIONAL WELLS

(71) Applicants: Volker Peters, Niedersachsen (DE); Andreas Peter, Celle (DE); Christian Fulda, Lower Saxony (DE); Heiko Eggers, Dorfmark (DE); Harald Grimmer, Niedersachsen (DE)

(72) Inventors: Volker Peters, Niedersachsen (DE); Andreas Peter, Celle (DE); Christian Fulda, Lower Saxony (DE); Heiko Eggers, Dorfmark (DE); Harald Grimmer, Niedersachsen (DE)

(73) Assignee: BAKER HUGHES, LLC, Houston, TX (US)

( * ) Notice: Subject to any disclaimer, the term of this patent is extended or adjusted under 35 U.S.C. 154(b) by 95 days.

(21) Appl. No.: 15/274,851

(22) Filed: Sep. 23, 2016

(65) Prior Publication Data

US 2017/0067333 A1 Mar. 9, 2017

Related U.S. Application Data

(63) Continuation-in-part of application No. 14/667,026, filed on Mar. 24, 2015.

(51) Int. Cl.
*E21B 7/06* (2006.01)
*E21B 47/00* (2012.01)
(Continued)

(52) U.S. Cl.
CPC ..... *E21B 7/067* (2013.01); *E21B 7/06* (2013.01); *E21B 17/20* (2013.01); *E21B 41/00* (2013.01);
(Continued)

(58) Field of Classification Search
CPC ..... E21B 7/067; E21B 7/062
See application file for complete search history.

(56) References Cited

U.S. PATENT DOCUMENTS 3,011,568 A 12/1961 Grimm
3,380,543 A 4/1968 Vincent
(Continued)

FOREIGN PATENT DOCUMENTS

AU 2005200137 A1 2/2005
CN 104114805 A 10/2014
(Continued)

OTHER PUBLICATIONS

PCT International Search Report and Written Opinion; International Application No. PCT/US2017/052654; International Filing Date: Sep. 21, 2017; dated Jan. 8, 2018; pp. 1-17.
(Continued)

*Primary Examiner* — Blake Michener
*Assistant Examiner* — Neel Girish Patel
(74) *Attorney, Agent, or Firm* — Cantor Colburn LLP

(57) ABSTRACT

An apparatus for drilling a directional wellbore is disclosed that in one non-limiting embodiment includes a drive for rotating a drill bit, a deflection device that enables a lower section of the drilling assembly to tilt about a member of the deflection device within a selected plane when the drilling assembly is substantially rotationally stationary to allow drilling of a curved section of the wellbore when the drill bit is rotated by the drive and wherein the tilt is reduced when the drilling assembly is rotated to allow drilling of a straighter section of the wellbore, and a tilt sensor that provides measurements relating to tilt of the lower section. A controller determines a parameter of interest relating to the tilt for controlling drilling of the directional wellbore.

29 Claims, 9 Drawing Sheets

(51) Int. Cl.

| | |
|---|---|
| ***E21B 44/04*** | (2006.01) |
| ***E21B 44/00*** | (2006.01) |
| ***E21B 47/024*** | (2006.01) |
| ***E21B 17/20*** | (2006.01) |
| ***E21B 41/00*** | (2006.01) |

(52) U.S. Cl.
CPC ..... *E21B 44/00* (2013.01); *E21B 44/04* (2013.01); *E21B 47/00* (2013.01); *E21B 47/024* (2013.01)

(56) References Cited

U.S. PATENT DOCUMENTS

| | | | | |
|---|---|---|---|---|
| 3,586,116 | A | 6/1971 | Francois et al. | |
| 4,442,908 | A | 4/1984 | Steenbock | |
| 4,522,272 | A | 6/1985 | Beimgraben | |
| 4,655,299 | A | 4/1987 | Schoeffler | |
| 4,811,798 | A | 3/1989 | Falgout, Sr. et al. | |
| 4,884,643 | A | 12/1989 | Wawrzynowski et al. | |
| 4,895,214 | A | 1/1990 | Schoeffler | |
| 5,048,621 | A | 9/1991 | Bailey et al. | |
| 5,117,927 | A | 6/1992 | Askew | |
| 5,154,243 | A | 10/1992 | Dudman | |
| 5,181,576 | A | 1/1993 | Askew et al. | |
| 5,259,467 | A | 11/1993 | Schoeffler | |
| 5,269,385 | A | 12/1993 | Sihlis | |
| 5,314,032 | A | 5/1994 | Pringle et al. | |
| 5,423,389 | A | 6/1995 | Warren et al. | |
| 5,778,992 | A | 7/1998 | Fuller | |
| 5,899,281 | A | 5/1999 | Gynz-Rekowski | |
| 5,941,323 | A | 8/1999 | Warren | |
| 6,047,784 | A | 4/2000 | Dorel | |
| 6,203,435 | B1 | 3/2001 | Falgout, Sr. | |
| 6,216,802 | B1 | 4/2001 | Sawyer | |
| 6,598,687 | B2 | 7/2003 | Eppink et al. | |
| 6,659,201 | B2 | 12/2003 | Head et al. | |
| 7,204,325 | B2 | 4/2007 | Song et al. | |
| 7,287,604 | B2 | 10/2007 | Aronstam et al. | |
| 7,392,857 | B1 | 7/2008 | Hall et al. | |
| 9,957,755 | B2 | 5/2018 | Schurmann | |
| 2001/0052427 | A1 | 12/2001 | Eppink et al. | |
| 2002/0007969 | A1 | 1/2002 | Head et al. | |
| 2003/0127252 | A1 | 7/2003 | Downton et al. | |
| 2005/0109542 | A1 | 5/2005 | Downton | |
| 2006/0243487 | A1 | 11/2006 | Turner et al. | |
| 2007/0163810 | A1 | 7/2007 | Underwood et al. | |
| 2008/0149394 | A1 | 6/2008 | Downton | |
| 2009/0133930 | A1 | 5/2009 | Thorp et al. | |
| 2009/0166089 | A1 | 7/2009 | Millet | |
| 2009/0205867 | A1* | 8/2009 | Reckmann ..... | E21B 47/024 175/24 |
| 2009/0260884 | A1 | 10/2009 | Santelmann | |
| 2009/0266611 | A1 | 10/2009 | Camp | |
| 2011/0308858 | A1 | 12/2011 | Menger et al. | |
| 2012/0018225 | A1* | 1/2012 | Peter ..... | E21B 7/067 175/61 |
| 2013/0043076 | A1 | 2/2013 | Larronde et al. | |
| 2014/0110178 | A1 | 4/2014 | Savage et al. | |
| 2014/0231136 | A1 | 8/2014 | Winslow | |
| 2015/0176344 | A1* | 6/2015 | McLoughlin ..... | E21B 17/1078 175/24 |
| 2016/0069139 | A1 | 3/2016 | Sugiura et al. | |
| 2016/0258218 | A1 | 9/2016 | Lange et al. | |
| 2016/0281431 | A1 | 9/2016 | Peters et al. | |
| 2017/0074041 | A1 | 3/2017 | Peters | |
| 2017/0074042 | A1 | 3/2017 | Peters et al. | |
| 2017/0247947 | A1 | 8/2017 | Savage et al. | |
| 2020/0392792 | A1 | 12/2020 | Peters et al. | |

FOREIGN PATENT DOCUMENTS

| | | | |
|---|---|---|---|
| EP | 0015137 | A1 | 9/1980 |
| GB | 2442303 | A | 4/2008 |
| RU | 2114273 | C1 | 6/1998 |
| RU | 2131508 | C1 | 6/1999 |
| RU | 2179226 | C2 | 2/2002 |
| RU | 2229012 | C2 | 5/2004 |
| RU | 2444604 | C1 | 3/2012 |
| WO | 2013122603 | A1 | 8/2013 |
| WO | WO-2013122603 | A1 * | 8/2013 |
| WO | 2014120326 | A1 | 8/2014 |
| WO | 2014200416 | A | 12/2014 |
| WO | 2016057445 | A1 | 4/2016 |

OTHER PUBLICATIONS

PCT International Search Report and Written Opinion; International Application No. PCT/US2016/023886; International Filing Date: Mar. 24, 2016; dated Jun. 27, 2016; pp. 1-13.

PCT International Search Report and Written Opinion; International Application No. PCT/US2017/052652; International Filing Date: Sep. 21, 2017; dated Jan. 4, 2018; pp. 1-16.

PCT International Search Report and Written Opinion; International Application No. PCT/US2017/052655; International Filing Date: Sep. 21, 2017; dated Dec. 14, 2017; pp. 1-15.

EP Search Report dated Mar. 24, 2020; EP Application No. EP 17853861; 8 pages.

European Search Report dated Nov. 9, 2018; Application No. EP 16769649; 8 pages.

International Search Report; PCT Application No. PCT/US2020/036956; dated Sep. 21, 2020; 4 pages.

Schlumberger Oilfield Glossary—https://www.glossary.oilfield.slb.com/en/terms/b/bottonhole_assembly (Year: 2020).

Schlumberger Oilfield Glossary—https://www.glossary.oilfield.slb.com/en/terms/s/sub (Year: 2020).

Written Opinion; PCT Application No. PCT/US2020/036956; dated Sep. 21, 2020; 8 pages.

* cited by examiner

DRILLING APPARATUS USING A SELF-ADJUSTING DEFLECTION DEVICE AND DEFLECTION SENSORS FOR DRILLING DIRECTIONAL WELLS

CROSS REFERENCES TO RELATED APPLICATION

This application is a continuation-in-part of U.S. patent application Ser. No. 14/667,026, filed on Mar. 24, 2015, the contents of which is hereby incorporated by reference herein in their entirety and assigned to the assignee of this application.

BACKGROUND

1. Field of the Disclosure

This disclosure relates generally to drilling directional wellbores.

2. Background of the Art

Wellbores or wells (also referred to as boreholes) are drilled in subsurface formations for the production of hydrocarbons (oil and gas) using a drill string that includes a drilling assembly (commonly referred to as a "bottomhole assembly" or "BHA") attached to a drill pipe bottom. A drill bit attached to the bottom of the drilling assembly is rotated by rotating the drill string from the surface and/or by a drive, such as a mud motor, in the drilling assembly. A common method of drilling curved sections and straight sections of wellbores (directional drilling) utilizes a fixed bend (also referred to as adjustable kick-off or "AKO") mud motor to provide a selected bend or tilt to the drill bit to form curved sections of wells. To drill a curved section, the drill string rotation from the surface is stopped, the bend of the AKO is directed into the desired build direction and the drill bit is rotated by the mud motor. Once the curved section is complete, the drilling assembly, including the bend, is rotated from the surface to drill a straight section. Such methods produce uneven boreholes. The borehole quality degrades as the tilt or bend is increased, causing effects like spiraling of the borehole. Other negative borehole quality effects attributed to the rotation of bent assemblies include drilling of over-gauge boreholes, borehole breakouts, and weight transfer. Such apparatus and methods also induce high stress and vibrations on the mud motor components compared to drilling assembles without an AKO and create high friction between the drilling assembly and the wellbore due to the bend contacting the inside of the wellbore as the drilling assembly rotates. Consequently, the maximum build rate is reduced by reducing the angle of the bend of the AKO to reduce the stresses on the mud motor and other components in the drilling assembly. Such methods result in additional time and expenses to drill such wellbores. Therefore, it is desirable to provide drilling assemblies and methods for drilling curved wellbore sections and straight sections without a fixed bend in the drilling assembly to reduce stresses on the drilling assembly components and utilizing various downhole sensors control drilling of the wellbore.

The disclosure herein provides apparatus and methods for drilling a wellbore, wherein the drilling assembly includes a deflection device that allows (or self-adjusts) a lower section of the drilling assembly connected to a drill bit to tilt or bend relative to an upper section of the drilling assembly when the drilling assembly is substantially rotationally stationary for drilling curved wellbore sections and straightens the lower section of the drilling assembly when the drilling assembly is rotated for drilling straight or relatively straight wellbore sections. Various sensors provide information about parameters relating to the drilling assembly direction, deflection device, drilling assembly behavior, and/or the subsurface formation that is the drilling assembly drills through that may be used to drill the wellbore along a desired direction and to control various operating parameters of the defection device, drilling assembly and the drilling operations.

SUMMARY

In one aspect, an apparatus for drilling a directional wellbore is disclosed that in one non-limiting embodiment includes a drive for rotating a drill bit, a deflection device that enables a lower section of a drilling assembly to tilt about a member of the deflection device within a selected plane when the drilling assembly is substantially rotationally stationary to allow drilling of a curved section of the wellbore when the drill bit is rotated by the drive and wherein the tilt is reduced when the drilling assembly is rotated to allow drilling of a straighter section of the wellbore, and a tilt sensor that provides measurements relating to tilt of the lower section. A controller determines a parameter of interest relating to the tilt for controlling drilling of the directional wellbore.

In another aspect, a method for drilling a directional wellbore is disclosed that in one embodiment includes: conveying a drilling assembly in the wellbore that includes: a drive for rotating a drill bit; a deflection device that enables a lower section of a drilling assembly to tilt about a member of the deflection device within a selected plane when the drilling assembly is substantially rotationally stationary to allow drilling of a curved section of the wellbore when the drill bit is rotated by the drive and wherein the tilt is reduced when the drilling assembly is rotated to allow drilling of a straighter section of the wellbore; and a tilt sensor that provides measurements relating to tilt of the lower section; drilling a straight section of the wellbore by rotating the drilling assembly from a surface location; causing the drilling assembly to become at least substantially rotationally stationary; determining a parameter of interest relating to the tilt of the lower section; and drilling a curved section of the wellbore by a drive in the drilling assembly in response to the determined parameter relating to the tilt.

Examples of the more important features of a drilling apparatus have been summarized rather broadly in order that the detailed description thereof that follows may be better understood, and in order that the contributions to the art may be appreciated. There are additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION

Figure 1:
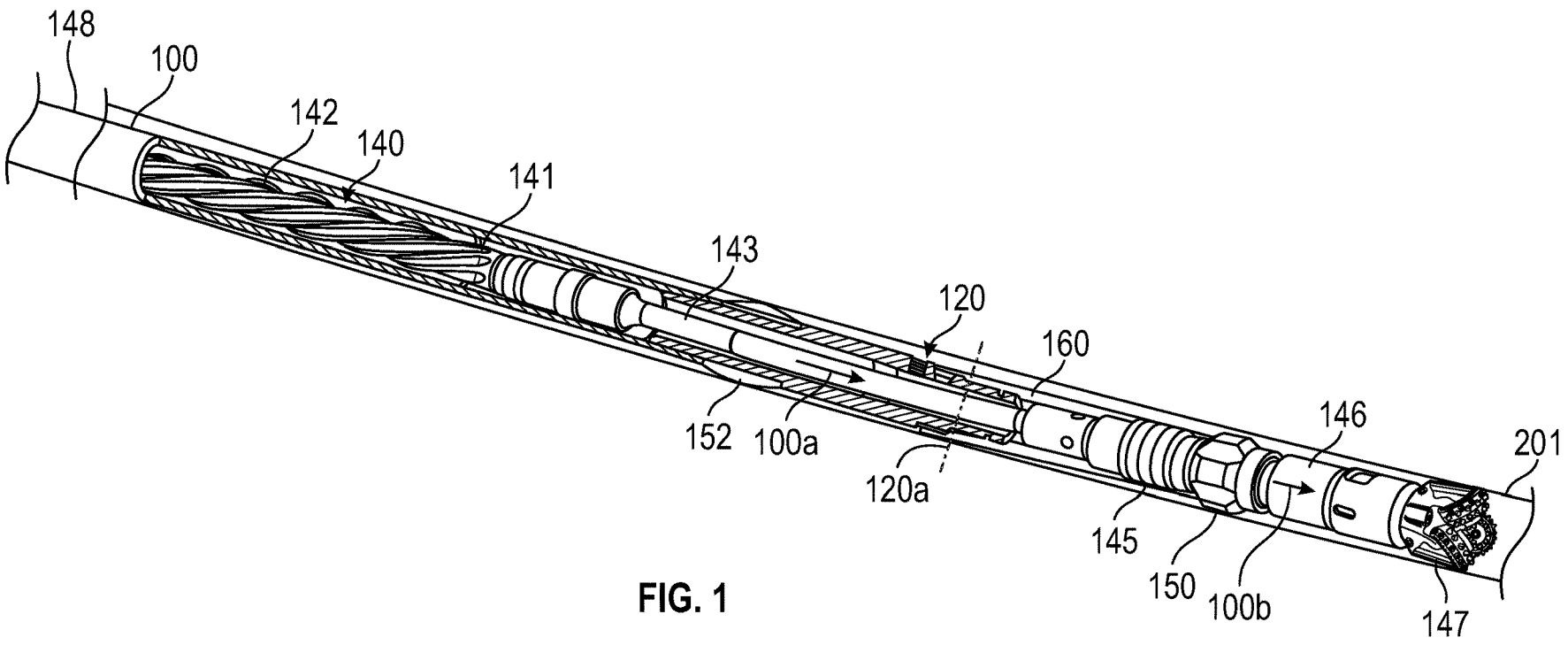
FIG. 1 shows a drilling assembly in a curved section of a wellbore that includes a deflection device or mechanism for drilling curved and straight sections of the wellbore, according to one non-limiting embodiment of the disclosure.

In aspects, the disclosure herein provides a drilling assembly or BHA for use in a drill string for directional drilling (drilling of straight and curved sections of a wellbore) that includes a deflection device that initiates a tilt to enable drilling of curved sections of wellbores and straightens itself to enable drilling of straight (vertical and tangent) sections of the wellbores. Such a drilling assembly allows drilling of straight sections when the drilling assembly is rotated and allows drilling of curved sections when the drilling assembly is stationary while the drill bit is rotated with the downhole drive. In aspects, directional drilling is achieved by using a self-adjusting "articulation joint" (also referred to herein as a "pivotal connection", "hinge device" or "hinged" device) to allow a tilt in the drilling assembly when the drill string and thus the drilling assembly is stationary and optionally using a dampener to maintain the drilling assembly straight when the drilling assembly is rotated. In other aspects a force application device, such as a spring or a hydraulic device, may be utilized to initiate or assist the tilt by applying a force into a hinged direction. In another aspect, the hinge device or hinged device is sealed from the outside environment (i.e., drilling fluid flowing through the drive, the wellbore, and/or the wellbore annulus). The hinge, about which a lower section of the drilling assembly having a drill bit at the end thereof tilts relative to an upper section of the drilling assembly, maybe sealed to exclude contaminants, abrasive, erosive fluids from relatively moving members. The term "upper section" of the drilling assembly is means the part of the drilling assembly that is located uphole of the hinge device and the term "lower section" of the drilling assembly is used for the part of the drilling assembly that is located downhole of the hinge device. In another aspect, the deflection device includes a stop that maintains the lower section at a small tilt (for example, about 0.05 degree or greater) to facilitate initiation of the tilt of the lower section relative to the upper section when the drill string is stationary. In another aspect, the stop may allow the lower section to attain a straight position relative to the upper section when the drill string is rotated. In another aspect, the deflection device includes another stop that defines the maximum tilt of the lower section relative to the upper section. The drilling system utilizing the drilling assembly described herein further includes one or more sensors that provide information or measurements relating to one or more parameters of interest, such as directional parameters, including, but not limited to, tool face inclination, and azimuth of at least a part of the drilling assembly. The term "tool face" is an angle between a point of interest such as a direction to which the deflection device points and a reference. The term "high side" is such a reference meaning the direction in a plane perpendicular about the tool axis where the gravitation is the lowest (negative maximum). Other references, such as "low side" and "magnetic north" may also be utilized. Other embodiments may include: sensors that provide measurements relating to the tilt and tilt rate in the deflection device; sensors that provide measurement relating to force applied by the lower section onto the upper section; sensors that provide information about behavior of the drilling assembly and the deflection device; and devices (also referred to as energy harvesting devices) that may utilize electrical energy harvested from motion (e.g. vibration) in the deflection device. A controller in the drilling assembly and/or at the surface determines one or more parameters from the sensor measurements and may be configured to communicate such information in real time via a suitable telemetry mechanism to the surface to enable an operator (e.g. an automated drilling controller or a human operator) to control the drilling operations, including, but not limited to, selecting the amount and direction of the tilt of the drilling assembly and thus the drill bit; adjusting operating parameters, such as weight applied on the drilling assembly, and drilling fluid pump rate. A controller in the drilling assembly and/or at the surface also may cause the drill bit to point along a desired direction with the desired tilt in response to one or more determined parameters of interest.

In other aspects, a drilling assembly made according to an embodiment of the disclosure: reduces wellbore spiraling, reduces friction between the drilling assembly and the wellbore wall during drilling of straight sections; reduces stress on components of the drilling assembly, including, but not limited to, a downhole drive (such as a mud motor, an electric drive, a turbine, etc.), and allows for easy positioning of the drilling assembly for directional drilling. For the purpose of this disclosure, the term stationary means to include rotationally stationary (not rotating) or rotating at a relatively small rotational speed (rpm), or angular oscillation between maximum and minimum angular positions (also referred to as "toolface fluctuations"). Also, the term "straight" as used in relation to a wellbore or the drilling assembly includes the terms "straight", "vertical" and "tangent" and further includes the phrases "substantially straight", "substantially vertical" or "substantially tangent". For example, the phrase "straight wellbore section" or "substantially straight wellbore section" will mean to include any wellbore section that is "perfectly straight" or a section that has a relatively small curvature as described above and in more detail later.

FIG. 1 shows a drilling assembly 100 in a curved section of a wellbore 101. In a non-limiting embodiment, the drilling assembly 100 includes a deflection device (also referred herein as a flexible device or a deflection mechanism) 120 for drilling curved and straight sections of the wellbore 101. The drilling assembly 100 further includes a downhole drive or drive, such as a mud motor 140, having a stator 141 and rotor 142. The rotor 142 is coupled to a transmission, such as a flexible shaft 143 that is coupled to another shaft 146 (also referred to as the "drive shaft") disposed in a bearing assembly 145. The shaft 146 is coupled to a disintegrating device, such as drill bit 147. The drill bit 147 rotates when the drilling assembly 100 and/or the rotor 142 of the mud motor 140 rotates due to circulation of a drilling fluid, such as mud, during drilling operations. In other embodiments, the downhole drive may include any other device that can rotate the drill bit 147, including, but not limited to an electric motor and a turbine. In certain other embodiments, the disintegrating device may include any another device suitable for disintegrating the rock formation, including, but not limited to, an electric impulse device (also referred to as electrical discharge device). The drilling assembly 100 is connected to a drill pipe 148, which is rotated from the surface to rotate the drilling assembly 100 and thus the drilling assembly 100 and the drill bit 147. In the particular drilling assembly configuration shown in FIG. 1, the drill bit 147 may be rotated by rotating the drill pipe 148 and thus the drilling assembly 100 and/or the mud motor 140. The rotor 142 rotates the drill bit 147 when a fluid is circulated through the drilling assembly 100. The drilling assembly 100 further includes a deflection device 120 having an axis 120*a* that may be perpendicular to an axis 100*a* of the upper section of the drilling assembly 100. While in FIG. 1 the deflection device 120 is shown below the mud motor 140 and coupled to a lower section, such as housing or tubular 160 disposed over the bearing assembly 145, the deflection device 120 may also be located above the drive 140. In various embodiments of the deflection device 120 disclosed herein, the housing 160 tilts a selected or known amount along a selected or known plane defined by the axis of the upper section of the drilling assembly 110*a* and the axis of the lower section of the drilling assembly 100*b* in FIG. 1) to tilt the drill bit 147 along the selected plane, which allows drilling of curved borehole sections. As described later in reference to FIGS. 2-6, the tilt is initiated when the drilling assembly 100 is stationary (not rotating) or substantially rotationally stationary. The curved section is then drilled by rotating the drill bit 147 by the mud motor 140 without rotating the drilling assembly 100. The deflection device 120 straightens when the drilling assembly is rotated, which allows drilling of straight wellbore sections. Thus, in aspects, the deflection device 120 allows a selected tilt in the drilling assembly 100 that enables drilling of curved sections along desired wellbore paths when the drill pipe 148 and thus the drilling assembly 100 is rotationally stationary or substantially rotationally stationary and the drill bit 147 is rotated by the drive 140. However, when the drilling assembly 100 is rotated, such as by rotating the drill pipe 148 from the surface, the tilt straightens and allows drilling of straight borehole sections, as described in more detail in reference to FIGS. 2-9. In one embodiment, a stabilizer 150 is provided below the deflection device 120 (between the deflection device 120 and the drill bit 147) that initiates a bending moment in the deflection device 120 and also maintains the tilt when the drilling assembly 100 is not rotated and a weight on the drill bit is applied during drilling of the curved borehole sections. In another embodiment a stabilizer 152 may be provided above the deflection device 120 in addition to or without the stabilizer 150 to initiate the bending moment in the deflection device 120 and to maintain the tilt during drilling of curved wellbore sections. In other embodiments, more than one stabilizer may be provided above and/or below the deflection device 120. Modeling may be performed to determine the location and number of stabilizers for optimum operation. In other embodiments, an additional bend may be provided at a suitable location above the deflection device 120, which may include, but not limited to, a fixed bend, a flexible bend a deflection device and a pin or hinge device.

Figure 2:
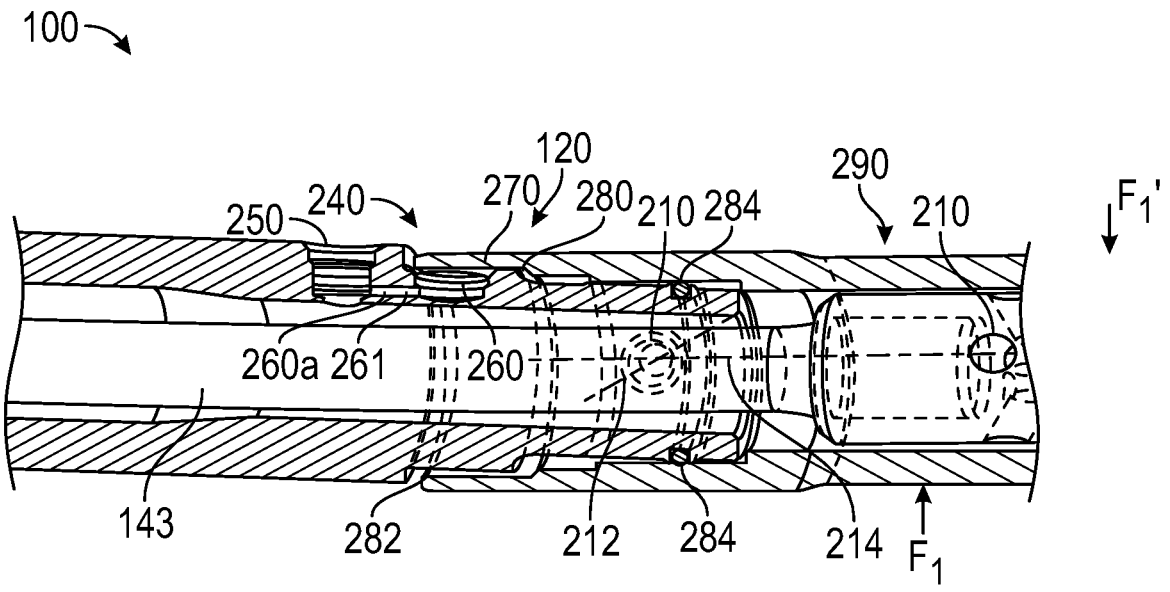
FIG. 2 shows a non-limiting embodiment of the deflection device of the drilling assembly of FIG. 1 when a lower section of the drilling assembly is tilted relative to an upper section.

FIG. 2 shows a non-limiting embodiment of a deflection device 120 for use in a drilling assembly, such as the drilling assembly 100 shown in FIG. 1. Referring to FIGS. 1 and 2, in one non-limiting embodiment, the deflection device 120 includes a pivot member, such as a pin or hinge 210 having an axis 212 that may be perpendicular to the longitudinal axis 214 of the drilling assembly 100, about which the housing 270 of a lower section 290 of the drilling assembly 100 tilts or inclines a selected amount relatively to the upper section 220 (part of an upper section) about the plane defined by the axis 212. The housing 270 tilts between a substantially straight end stop 282 and an inclined end stop 280 that defines the maximum tilt. When the housing 270 of the lower section 290 is tilted in the opposite direction, the straight end stop 282 defines the straight position of the drilling assembly 100, where the tilt is zero or alternatively a substantially straight position when the tilt is relatively small but greater than zero, such as about 0.2 degrees or greater. Such a tilt can aid in initiating the tilt of the lower section 290 of the drilling assembly 100 for drilling curved sections when the drilling assembly is rotationally stationary. In such embodiments, the housing 270 tilts along a particular plane or radial direction as defined by the pin axis 212. One or more seals, such as seal 284, provided between the inside of the housing 270 and another member of the drilling assembly 100 seals the inside section of the housing 270 below the seal 284 from the outside environment, such as the drilling fluid.

Still referring to FIGS. 1 and 2, when a weight on the bit 147 is applied and drilling progresses while the drill pipe 148 is substantially rotationally stationary, it will initiate a tilt of the housing 270 about the pin axis 212 of the pin 210. The drill bit 147 and/or the stabilizer 150 below the deflection device 120 initiates a bending moment in the deflection device 120 and also maintains the tilt when the drill pipe 148 and thus the drilling assembly 100 is substantially rotationally stationary and a weight on the drill bit 147 is applied during drilling of the curved wellbore sections. Similarly, stabilizer 152, in addition to or without the stabilizer 150 and the drill bit, may also determine the bending moment in the deflection device 120 and maintains the tilt during drilling of curved wellbore sections. Stabilizers 150 and 152 may be rotating or non-rotating devices. In one non-limiting embodiment, a dampening device or dampener 240 may be provided to reduce or control the rate of the tilt variation when the drilling assembly 100 is rotated. In one non-limiting embodiment, the dampener 240 may include a piston 260 and a compensator 250 in fluid communication with the piston 260 via a line 260*a* to reduce, restrict or control the rate of the tilt variation. Applying a force F1 on the housing 270 will cause the housing 270 and thus the lower section 290 to tilt about the pin axis 212. Applying a force F1' opposite to the direction of force F1 on the housing 270 causes the housing 270 and thus the drilling assembly 100 to straighten or to tilt into the opposite direction of force F1'. The dampener may also be used to stabilize the straightened position of the housing 270 during rotation of the drilling assembly 100 from the surface. The operation of the dampening device 240 is described in more detail in reference to FIGS. 6A and 6B. Any other suitable device, however, may be utilized to reduce or control the rate of the tilt variation of the drilling assembly 100 about the pin 210.

Figure 3:
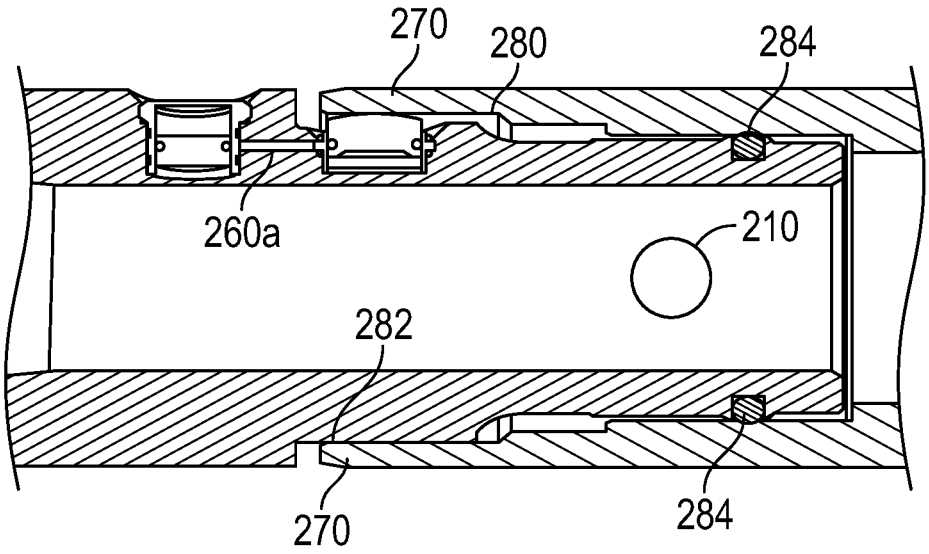
FIG. 3 shows the deflection device of the drilling assembly of FIG. 2 when the lower section of the drilling assembly is straight relative the upper section.

Referring now to FIGS. 1-3, when the drill pipe 148 is substantially rotationally stationary (not rotating) and a weight is applied on the drill bit 147 while the drilling is progressing, the deflection device will initiate a tilt of the drilling assembly 100 at the pivot 210 about the pivot axis 212. The rotating of the drill bit 147 by the downhole drive 140 will cause the drill bit 147 to initiate drilling of a curved section. As the drilling continues, the continuous weight applied on the drill bit 147 will continue to increase the tilt until the tilt reaches the maximum value defined by the inclined end stop 280. Thus, in one aspect, a curved section may be drilled by including the pivot 210 in the drilling assembly 100 with a tilt defined by the inclined end stop 280. If the dampening device 240 is included in the drilling assembly 100 as shown in FIG. 2, tilting the drilling assembly 100 about the pivot 210 will cause the housing 270 in section 290 to apply a force F1 on the piston 260, causing a fluid 261, such as oil, to transfer from the piston 260 to the compensator 250 via a conduit or path, such as line 260*a*. The flow of the fluid 261 from the piston 260 to the compensator 250 may be restricted to reduce or control the rate of the tilt variation and avoid sudden tilting of the lower section 290, as described in more detail in reference to FIGS. 6A and 6B. In the particular illustrations of FIGS. 1 and 2, the drill bit 147 will drill a curved section upward. To drill a straight section after drilling the curved section, the drilling assembly 100 may be rotated 180 degrees to remove the tilt and then later rotated from the surface to drill the straight section. However, when the drilling assembly 100 is rotated, based on the positions of the stabilizers 150 and/or 152 or other wellbore equipment between the deflection device 120 and the drill bit 147 and in contact with the wellbore wall, bending forces in the wellbore act on the housing 270 and exert forces in opposite direction to the direction of force F1, thereby straightening the housing 270 and thus the drilling assembly 100, which allows the fluid 261 to flow from the compensator 250 to the piston 260 causing the piston to move outwards. Such fluid flow may or may not be restricted, which allows the housing 270 and thus the lower section 290 to straighten rapidly (without substantial delay). The outward movement of the piston 260 may be supported by a spring, positioned in force communication with the piston 260, the compensator 250, or both. The straight end stops 282 restricts the movement of the member 270, causing the lower section 290 to remain straight as long as the drilling assembly 100 is being rotated. Thus, the embodiment of the drilling assembly 100 shown in FIGS. 1 and 2 provides a self-initiating tilt when the drilling assembly 120 is stationary (not rotated) or substantially stationary and straightens itself when the drilling assembly 100 is rotated. Although the downhole drive 140 shown in FIG. 1 is shown to be a mud motor, any other suitable drive may be utilized to rotate the drill bit 147. FIG. 3 shows the drilling assembly 100 in the straight position, wherein the housing 270 rests against the straight end stop 282.

Figure 4:
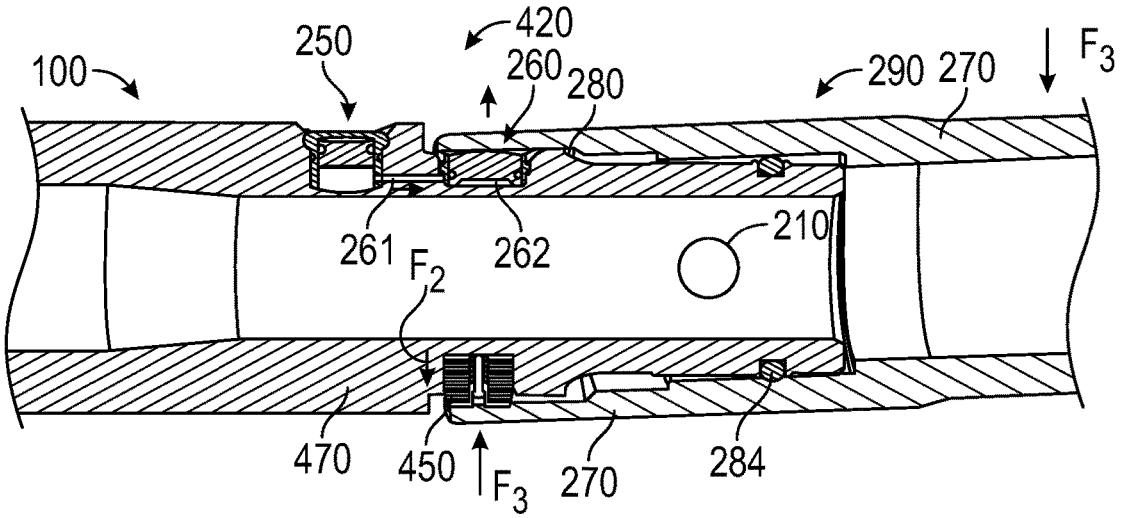
FIG. 4 shows a non-limiting embodiment of a deflection device that includes a force application device that initiates the tilt in a drilling assembly, such as the drilling assembly shown in FIG. 1.

FIG. 4 shows another non-limiting embodiment of a deflection device 420 that includes a force application device, such as a spring 450, that continually exerts a radially outward force F2 on the housing 270 of the lower section 290 to provide or initiate a tilt to the lower section 290. In one embodiment, the spring 450 may be placed between the inside of the housing 270 and a housing 470 outside the transmission 143 (FIG. 1). In this embodiment, the spring 450 causes the housing 270 to tilt radially outward about the pivot 210 up to the maximum bend defined by the inclined end stop 280. When the drilling assembly 100 is stationary (not rotating) or substantially rotationally stationary, a weight on the drill bit 147 is applied and the drill bit is rotated by the downhole drive 140, the drill bit 147 will initiate the drilling of a curved section. As drilling continues, the tilt increases to its maximum level defined by the inclined end stop 280. To drill a straight section, the drilling assembly 100 is rotated from the surface, which causes the borehole to apply force F3 on the housing 270, compressing the spring 450 to straighten the drilling assembly 100. When the spring 450 is compressed by application of force F3, the housing 270 relieves pressure on the piston 260, which allows the fluid 261 from the compensator 250 to flow through line 262 back to piston 260 without substantial delay as described in more detail in reference to FIGS. 6A and 6B.

Figure 5:
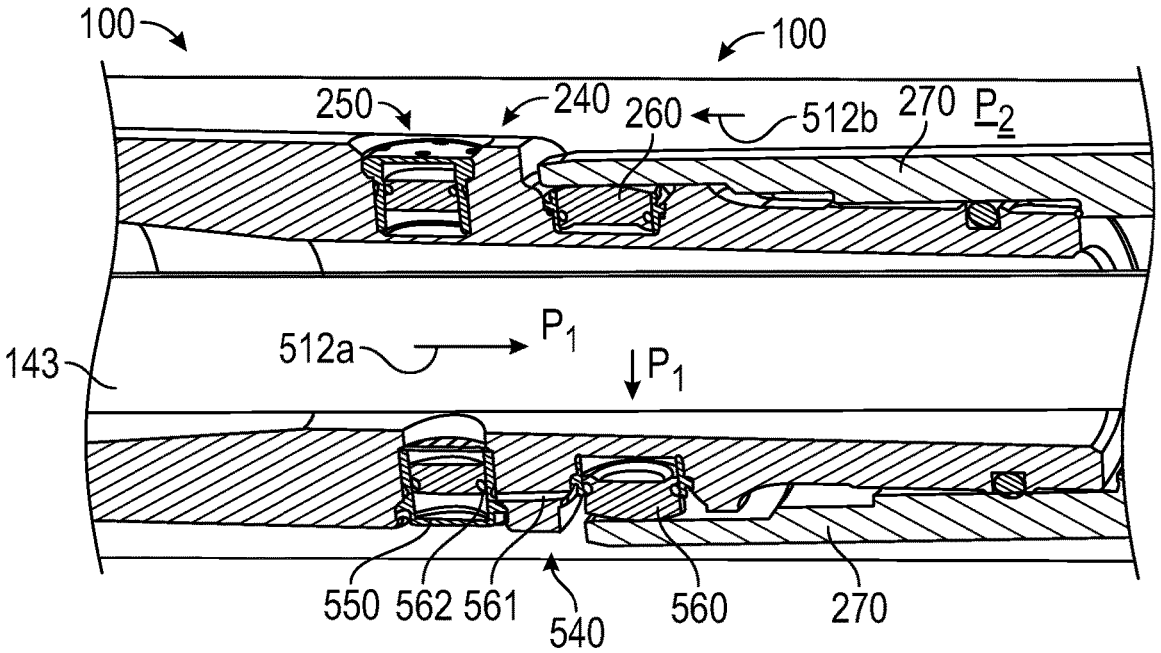
FIG. 5 shows a non-limiting embodiment of a hydraulic device that initiates the tilt in a drilling assembly, such as the drilling assembly shown in FIG. 1.

FIG. 5 shows a non-limiting embodiment of a hydraulic force application device 540 to initiate a selected tilt in the drilling assembly 100. In one non-limiting embodiment, the hydraulic force application device 540 includes a piston 560 and a compensation device or compensator 550. The drilling assembly 100 also may include a dampening device or dampener, such as dampener 240 shown in FIG. 2. The dampening device 240 includes a piston 260 and a compensator 250 shown and described in reference to FIG. 2. The hydraulic force application device 540 may be placed 180 degrees from device 240. The piston 560 and compensator 550 are in hydraulic communication with each other. During drilling, a fluid 512*a*, such as drilling mud, flows under pressure through the drilling assembly 100 and returns to the surface via an annulus between the drilling assembly 100 and the wellbore as shown by fluid 512*b*. The pressure P1 of the fluid 512*a* in the drilling assembly 100 is greater (typically 20-50 bars) than the pressure P2 of the fluid 512*b* in the annulus. When fluid 512*a* flows through the drilling assembly 100, pressure P1 acts on the compensator 550 and correspondingly on the piston 560 while pressure P2 acts on compensator 250 and correspondingly on piston 260. Pressure P1 being greater than pressure P2 creates a differential pressure (P1−P2) across the piston 560, which pressure differential is sufficient to cause the piston 560 to move radially outward, which pushes the housing 270 outward to initiate a tilt. A restrictor 562 may be provided in the compensator 550 to reduce or control the rate of the tilt variation as described in more detail in reference to FIGS.

6A and 6B. Thus, when the drill pipe 148 is substantially rotationally stationary (not rotating), the piston 560 slowly bleeds the hydraulic fluid 561 through the restrictor 562 until the full tilt angle is achieved. The restrictor 562 may be selected to create a high flow resistance to prevent rapid piston movement which may be present during tool face fluctuations of the drilling assembly to stabilize the tilt. The differential pressure piston force is always present during circulation of the mud and the restrictor 562 limits the rate of the tilt. When the drilling assembly 100 is rotated, bending moments on the housing 270 force the piston 560 to retract, which straightens the drilling assembly 100 and then maintains it straight as long as the drilling assembly 100 is rotated. The dampening rate of the dampening device 240 may be set to a higher value than the rate of the device 540 in order to stabilize the straightened position during rotation of the drilling assembly 100.

Figure 6A:
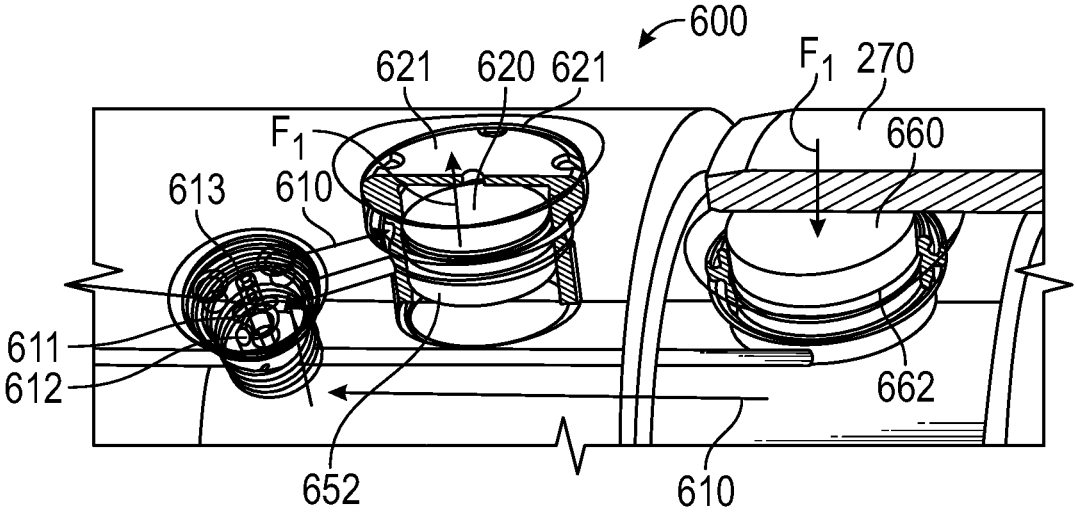
FIGS. 6A and 6B show certain details of a dampener, such as the dampener shown in FIGS. 2-5 to reduce or control the rate of the tilt of the drilling assembly.
Figure 6B:
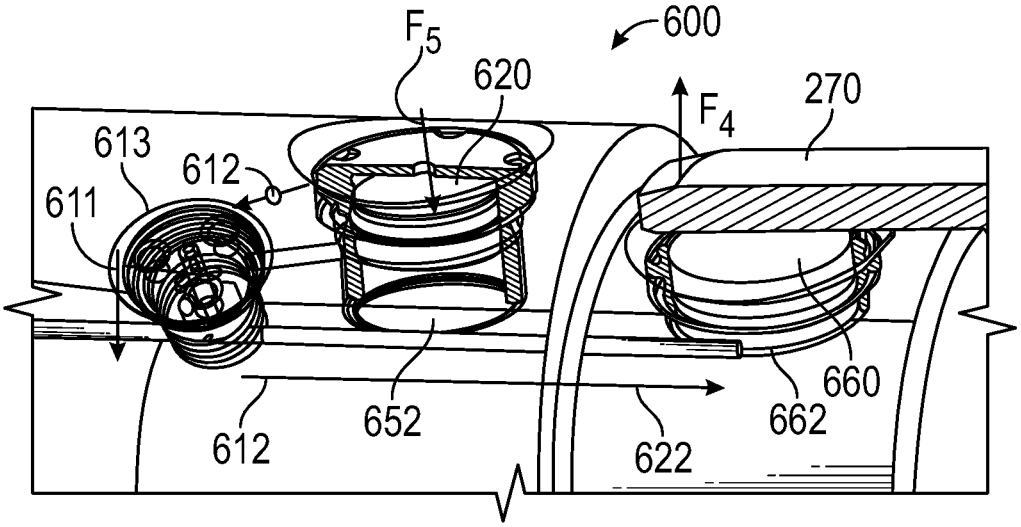

FIGS. 6A and 6B show certain details of the dampening device 600, which is the same as device 240 in FIGS. 2, 4 and 5. Referring to FIG. 2 and FIGS. 6A and 6B, when the housing 270 applies force F1 on the piston 660, it moves a hydraulic fluid (such as oil) from a chamber 662 associated with the piston 660 to a chamber 652 associated with a compensator 620, as shown by arrow 610. A restrictor 611 restricts the flow of the fluid from the chamber 662 to chamber 652, which increases the pressure between the piston 660 and the restrictor 611, thereby restricting or controlling the rate of the tilt. As the hydraulic fluid flow continues through the restrictor 611, the tilt continues to increase to the maximum level defined by the end inclination stop 280 shown and described in reference to FIG. 2. Thus, the restrictor 611 defines the rate of the tilt variation. Referring to FIG. 6B, when force F1 is released from the housing 270, as shown by arrow F4, force F5 on compensator 620 moves the fluid from chamber 652 back to the chamber 662 of piston 660 via a check valve 612, bypassing the restrictor 611, which enables the housing 270 to move to its straight position without substantial delay. A pressure relief valve 613 may be provided as a safety feature to avoid excessive pressure beyond the design specification of hydraulic elements.

Figure 7:
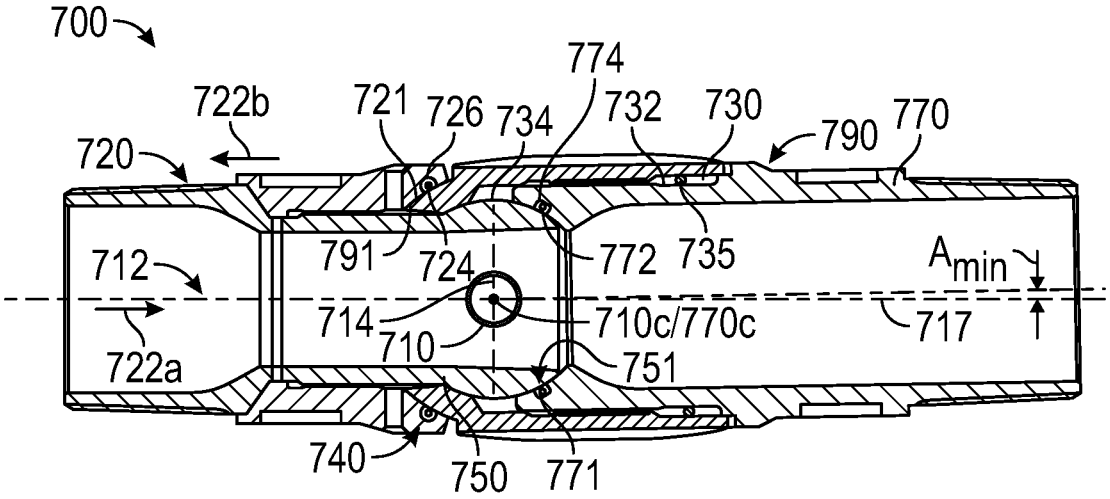
FIG. 7 shows a non-limiting embodiment of a deflection device that includes a sealed hydraulic section and a predefined minimum tilt of the lower section relative to the upper section.

FIG. 7 shows an alternative embodiment of a deflection device 700 that may be utilized in a drilling assembly, such as drilling assembly 100 shown in FIG. 1. The deflection device 700 includes a pin 710 with a pin axis 714 perpendicular to the tool axis 712. The pin 710 is supported by a support member 750. The deflection device 700 is connected to a lower section 790 of a drilling assembly and includes a housing 770. The housing 770 includes an inner curved or spherical surface 771 that moves over an outer mating curved or spherical surface 751 of the support member 750. The deflection device 700 further includes a seal 740 mechanism to separate or isolate a lubricating fluid (internal fluid) 732 from the external pressure and fluids (fluid 722*a* inside the drilling assembly and fluid 722*b* outside the drilling assembly). In one embodiment, the deflection device 700 includes a groove or chamber 730 that is open to and communicates the pressure of fluid 722*a* or 722*b* to a lubricating fluid 732 via a movable seal to an internal fluid chamber 734 that is in fluid communication with the surfaces 751 and 771. A floating seal 735 provides pressure compensation to the chamber 734. A seal 772 placed in a groove 774 around the inner surface 771 of the housing 770 seals or isolates the fluid 732 from the outside environment. Alternatively, the seal member 772 may be placed inside a groove around the outer surface 751 of the support member 750. In these configurations, the center 770*c* of the surface 771 is same or about the same as the center 710*c* of the pin 710. In the embodiment of FIG. 7, when the lower section 790 tilts about the pin 710, the surface 771 along with the seal member 772 moves over the surface 751. If the seal 772 is disposed inside the surface 751, then the seal member 772 will remain stationary along with the support member 750. The seal mechanism 740 further includes a seal that isolates the lubrication fluid 732 from the external pressure and external fluid 722*b*. In the embodiment shown in FIG. 7, this seal includes an outer curved or circular surface 791 associated with the lower section 790 that moves under a fixed mating curved or circular surface 721 of the upper section 720. A seal member, such as an O-ring 724, placed in a groove 726 around the inside of the surface 721 seals the lubricating fluid 732 from the outside pressure and fluid 722*b*. When the lower section tilts about the pin 710, the surface 791 moves under the surface 721, wherein the seal 724 remains stationary. Alternatively, the seal 724 may be placed inside the outer surface 791 and in that case, such a seal will move along with the surface 791. Thus, in aspects, the disclosure provides a sealed deflection device, wherein the lower section of a drilling assembly, such as section 790, tilts about sealed lubricated surfaces relative to the upper section, such as section 720. In one embodiment, the lower section 790 may be configured that enables the lower section 790 to attain perfectly straight position relative to the upper section 220. In such a configuration, the tool axis 712 and the axis 717 of the lower section 790 will align with each other. In another embodiment, the lower section 790 may be configured to provide a permanent minimum tilt of the lower section 290 relative to the upper section, such as tilt $A_{min}$ shown in FIG. 7. Such a tilt can aid the lower section to tilt from the initial position of tilt Amin to a desired tilt compared to a no initial tilt of the lower section. As an example, the minimum tilt may be 0.2 degree or greater may be sufficient for a majority of drilling operations.

Figure 8:
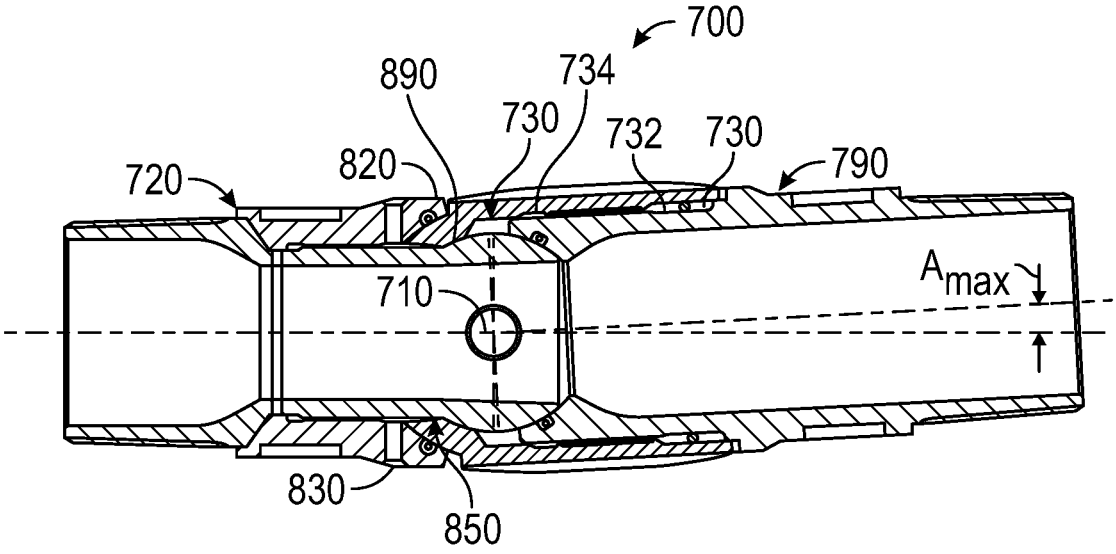
FIG. 8 shows the deflection device of FIG. 7 with the maximum tilt.

FIG. 8 shows the deflection device 700 of FIG. 7 when the lower section 790 has attained a full or maximum tilt or tilt angle $A_{max}$. In one embodiment, when the lower section 790 continues to tilt about the pin 210, a surface 890 of the lower section 790 is stopped by a surface 820 of the upper section 720. The gap 850 between the surfaces 890 and 820 defines the maximum tilt angle $A_{max}$. A port 830 is provided to fill the chamber 733 with the lubrication fluid 732. In one embodiment a pressure communication port 831 is provided for to allow pressure communication of fluid 722*b* outside the drilling assembly with the chamber 730 and the pressure of the internal fluid chamber 734 via the floating seal 735. In FIG. 8, shoulder t820 acts as the tilt end stop. The internal fluid chamber 734 may also be used as a dampening device. The dampener device uses fluid present at the gap 850 as displayed in FIG. 8 in a maximum tilt position defined by the maximum tilt angle $A_{max}$ being forced or squeezed from the gap 850 when the tilt is reduced towards $A_{min}$. Suitable fluid passages are designed to enable and restrict flow between both sides of the gap 850 and other areas of the fluid chamber 734 that exchange fluid volume by movement of the deflection device. To support the dampening, suitable seals, gap dimensions or labyrinth seals may be added. The lubricating fluid 732 properties in terms of density and viscosity can be selected to adjust the dampening parameters.

Figure 9:
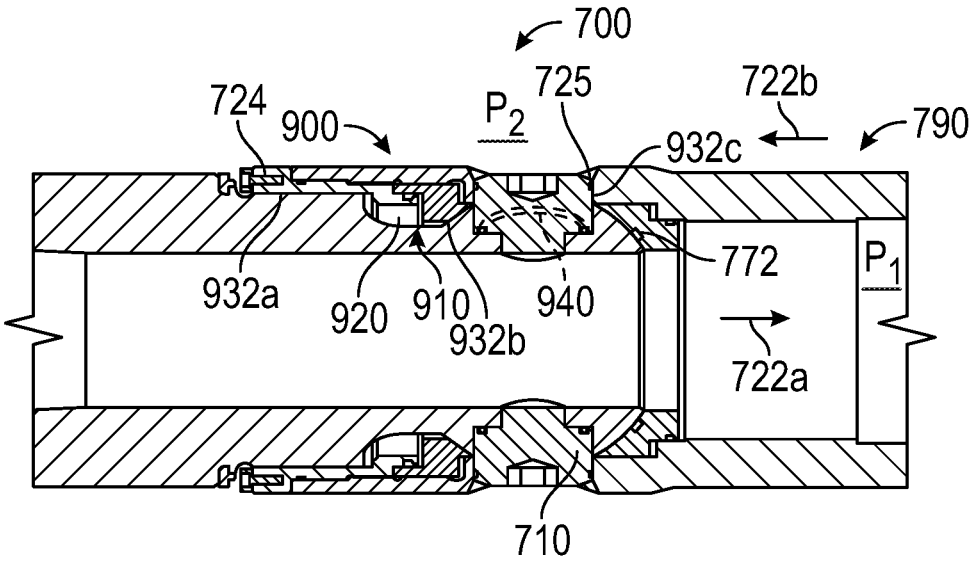
FIG. 9 is a 90 degree rotated view of the deflection device of FIG. 7 showing a sealed hydraulic section with a lubricant therein that provides lubrication to the seals of the deflection device shown in FIG. 7.

FIG. 9 is a 90 degree rotated view of the deflection device 700 of FIG. 7 showing a sealed hydraulic section 900 of the deflection device 700. In one non-limiting embodiment, the sealed hydraulic section 900 includes a reservoir or chamber 910 filled with a lubricant 920 that is in fluid communication with each of the seals in the deflection device 700 via certain fluid flow paths. In FIG. 9, a fluid path 932*a* provides lubricant 920 to the outer seal 724, fluid path 932*b* provides lubricant 720 to a stationary seal 940 around the pin 710 and a fluid flow path 932*c* provides lubricant 920 to the inner seal 772. In the configuration of FIG. 9, seal 772 isolates the lubricant from contamination from the drilling fluid 722*a* flowing through the drilling assembly and from pressure P1 of the drilling fluid 722*a* inside the drilling assembly that is higher than pressure P2 on the outside of the drilling assembly during drilling operations. Seal 724 isolates the lubricant 920 from contamination by the outer fluid 722*b*. In one embodiment seal 724 may be a bellows seal. The flexible bellows seal may be used as a pressure compensation device (instead of using a dedicated device, such as a floating seal 735 as described in reference to FIGS. 7 and 8) to communicate the pressure from fluid 722*b* to the lubricant 920. Seal 725 isolates the lubricant 920 from contamination by the outer fluid 722*b* and around the Pin 710. Seal 725 allows differential movement between the pin 710 and the lower section member 790. Seal 725 is also in fluid communication with the lubricant 920 through fluid flow path 932*c*. Since the pressure between fluid 722*b* and the lubricant 920 is equalized through seal 724, the pin seal 725 does not isolate two pressure levels, enabling longer service life for a dynamic seal function, such as for seal 725.

Figure 10:
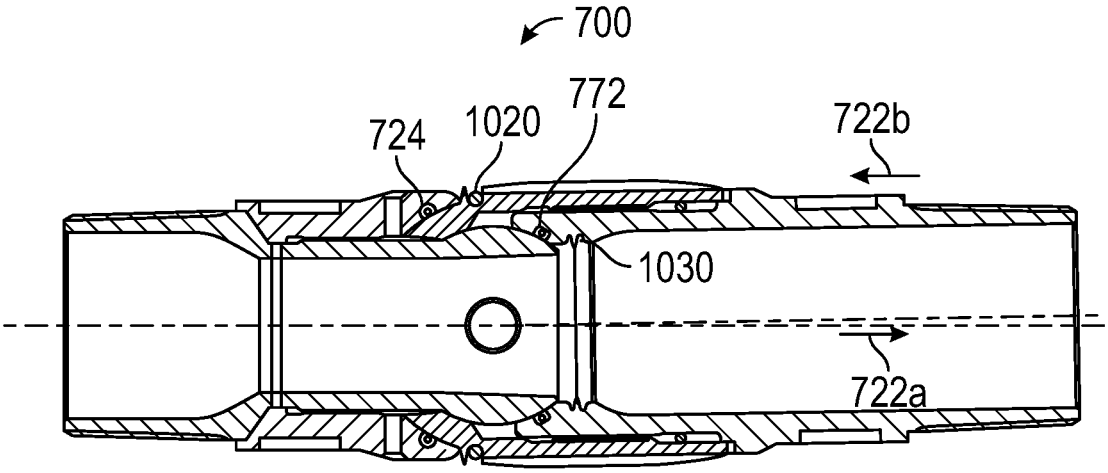
FIG. 10 shows a 90 degree rotated view of the deflection device of FIG. 9 that further includes flexible seals to isolate the seals shown in FIG. 9 from the outside environment.

FIG. 10 shows the deflection device 700 of FIG. 7 that may be configured to include one or more flexible seals to isolate the dynamic seals 724 and 772 from the drilling fluid. A flexible seal is any seal that expands and contracts as the lubricant volume inside such a seal respectively increases and decreases and one that allows for the movement between parts that are desired to be sealed. Any suitable flexible may be utilized, including, but not limited to, a bellow seal, and a flexible rubber seal. In the configuration of FIG. 10, a flexible seal 1020 is provided around the dynamic seal 724 that isolates the seal 724 from fluid 722*b* on the outside of the drilling assembly. A flexible seal 1030 is provided around the dynamic seal 772 that protects the seal 772 from the fluid 722*a* inside the drilling assembly. A deflection device made according to the disclosure herein may be configured: a single seal, such as seal 772, that isolates the fluid flowing through the drilling assembly inside and its pressure from the fluid on the outside of the drilling assembly; a second seal, such as seal 724, that isolates the outside fluid from the inside fluid or components of the deflection device 700; one or more flexible seals to isolate one or more other seals, such as the dynamic seals 724 and 772; and a lubricant reservoir, such as reservoir 920 (FIG. 9) enclosed by at least two seals to lubricate the various seals of the deflection device 700.

Figure 11:
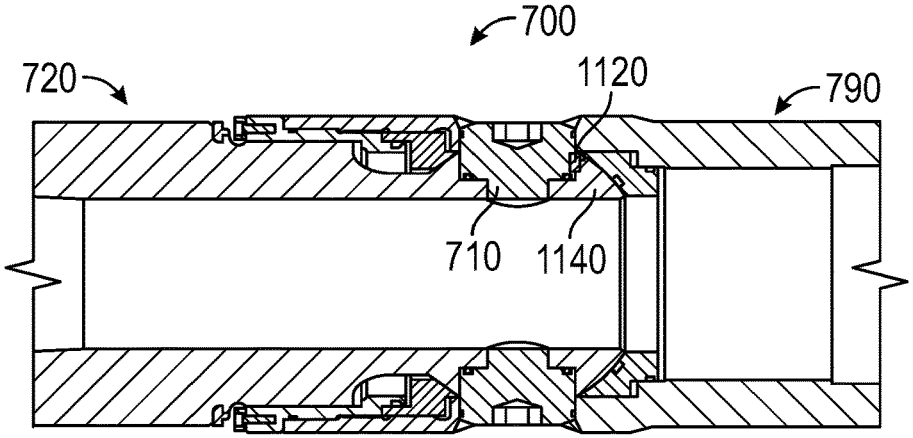
FIG. 11 shows the deflection device of FIG. 9 that includes a locking device that prevents a pin or hinge member of the deflection device from rotating.

FIG. 11 shows the deflection device of FIG. 9 that includes a locking device to prevent the pin or hinge member 710 of the deflection device from rotating. In the configuration of FIG. 11, a locking member 1120 may be placed between the pin 710 and a member or element of the non-moving member 720 of the drilling assembly. The locking member 1120 may be a keyed element or member, such as a pin, that prevents rotation of the pin 710 when the lower section 790 tilts or rotates about the pin 710. Any other suitable device or mechanism also may be utilized as the locking device, including, but not limited to, a friction and adhesion devices.

Figure 12:
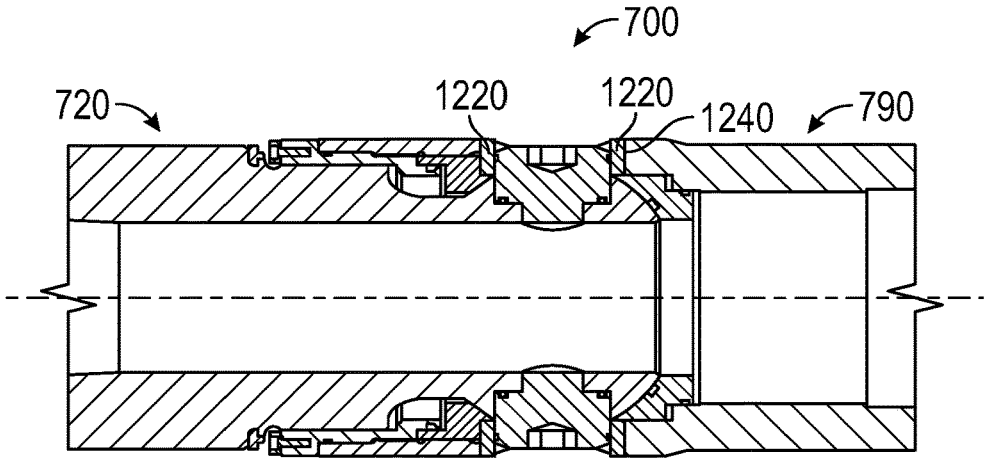
FIG. 12 shows the deflection device of FIG. 11 that includes a device that reduces friction between a pin or hinge member of the deflection device and a member or surface of the lower section that moves about the pin.

FIG. 12 shows the deflection device 700 of FIG. 10 that includes a friction reduction device 1220 between the pin or hinge member 710 of the deflection device 700 and a member or surface 1240 of the lower section 790 that moves about the pin 710. The friction reduction device 1220 may be any device that reduces friction between moving members, including, but not limited to bearings.

Figure 13:
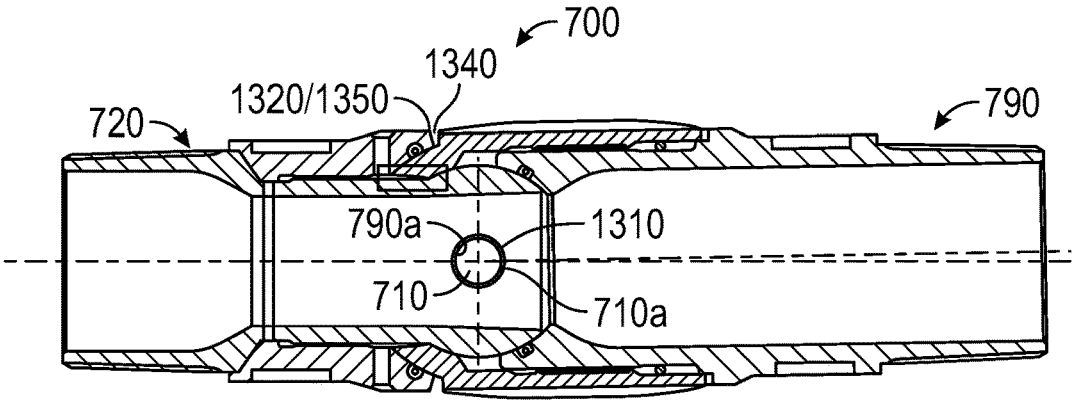
FIG. 13 shows the deflection device of FIG. 7 that includes sensors that provide measurements relating to the tilt of the lower section of the drilling assembly with respect to the upper section and sensors that provide measurements relating to force applied by the lower section on the upper section during drilling of wellbores.

FIG. 13 shows the deflection device 700 of FIG. 7 that in one aspect includes a sensor 1310 that provides measurements relating to the tilt or tilt angle of the lower section 790 relative to the upper section 710. In one non-limiting embodiment, sensor 1310 (also referred herein as the tilt sensor) may be placed along, about or at least partially embedded in the pin 710. Any suitable sensor may be used as sensor 1310 to determine the tilt or tilt angle, including, but not limited to, an angular sensor, a hall-effect sensor, a magnetic sensor, and contact or tactile sensor. Such sensors may also be used to determine the rate of the tilt variation. If such a sensor includes two components that face each other or move relative to each other, then one such component may be placed on, along or embedded in an outer surface 710*a* of the pin 710 and the other component may be placed on, along or embedded on an inside 790*a* of the lower section 790 that moves or rotates about the pin 710. In another aspect, a distance sensor 1320 may be placed, for example, in the gap 1340 that provides measurements about the distance or length of the gap 1340. The gap length measurement may be used to determine the tilt or the tilt angle or the rate of the tilt variation. Additionally, one or more sensors 1350 may be placed in the gap 1340 to provide signal relating to the presence of contact between and the amount of the force applied by the lower section 790 on the upper section 720.

Figure 14:
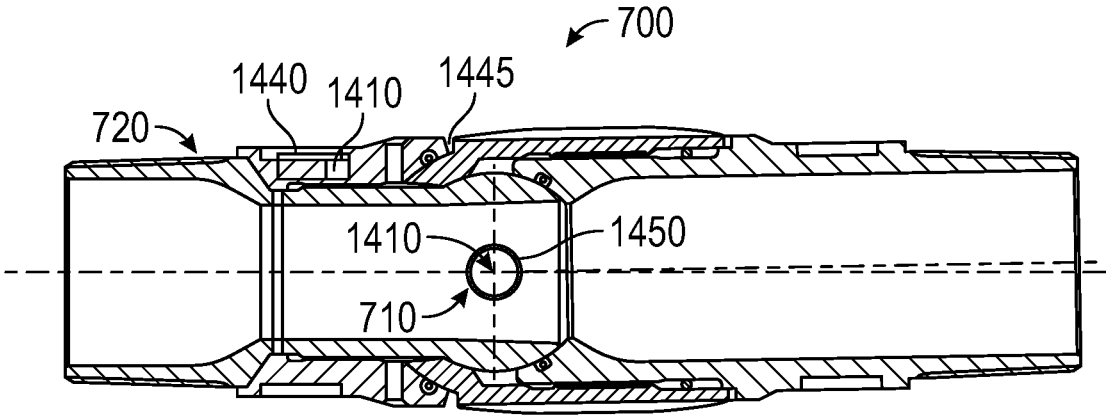
FIG. 14 shows the deflection device of FIG. 7 showing a non-limiting embodiment relating to placement of sensors relating to directional drilling and drilling assembly parameters.

FIG. 14 shows the deflection device 700 of FIG. 7 that includes sensors 1410 in a section 1440 of the upper section 720 that provide information about the drilling assembly parameters and the wellbore parameters that are useful for drilling the wellbore along a desired well path, sometimes referred to in the art as "geosteering". Some such sensors may include sensors that provide measurements relating to parameters such as tool face, inclination (gravity), and direction (magnetic). Accelerometers, magnetometers, and gyroscopes may be utilized for such parameters. In addition, a vibration sensor may be located at location 1440. In one non-limiting embodiment, section 1440 may be in the upper section 720 proximate to the end stop 1445. Sensors 1410, however, may be located at any other suitable location in the drilling assembly above or below the deflection device 700 or in the drill bit. In addition, sensors 1450 may be placed in the pin 710 for providing information about certain physical conditions of the deflection device 700, including, but not limited to, torque, bending and weight. Such sensors may be placed in and/or around the pin 710 as relevant forces relating to such parameters are transferred through the pin 710.

Figure 15:
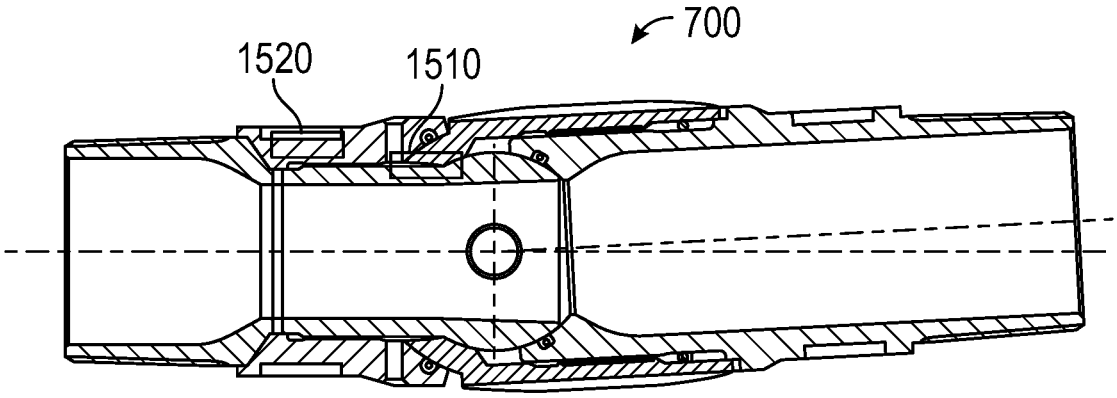
FIG. 15 shows the deflection device of FIG. 7 that includes a device for generating electrical energy due to vibration or motion in the drilling assembly during drilling of the wellbore.

FIG. 15 shows the deflection device 700 of FIG. 7 that includes a device 1510 for generating electrical energy due deflection dynamics, such as vibration, motion and strain energy in the defection device 700 and the drilling assembly. The device 1510 may include, but is not limited to, piezoelectric crystals, electromagnetic generator, MEMS device. The generated energy may be stored in a storage device, such as battery or a capacitor 1520, in the drilling assembly and may be utilized to power various sensors, electrical circuits and other devices in the drilling assembly.

Referring to FIGS. 13-14, signals from sensors 1310, 1320, 1350, 1410, and 1450 may be transmitted or communicated to a controller or another suitable circuit in the drilling assembly by hard wire, optical device or wireless transmission method, including, but limited to, acoustic, radio frequency and electromagnetic methods. The controller in the drilling assembly may process the sensor signals, store such information a memory in the drilling assembly and/or communicate or transmit in real time relevant information to a surface controller via any suitable telemetry method, including, but not limited to, wired pipe, mud pulse telemetry, acoustic transmission, and electromagnetic telemetry. The tilt information from sensor 1310 may be utilized by an operator to control drilling direction along a desired or predetermined well path, i.e. geosteering and to control operating parameters, such as weight on bit. Information about the force applied by the lower section 790 onto the upper section 720 by sensor 1320 may be used to control the weight on the drill bit to mitigate damage to the deflection device 700. Torque, bending and weight information from sensors 1450 is relevant to the health of the deflection device and the drilling process and may be utilized to control drilling parameter, such as applied and transferred weight on the drill bit. Information about the pressure inside the drilling assembly and in the annuls may be utilized to control the differential pressure around the seals and thus on the lubricant.

Figure 16:
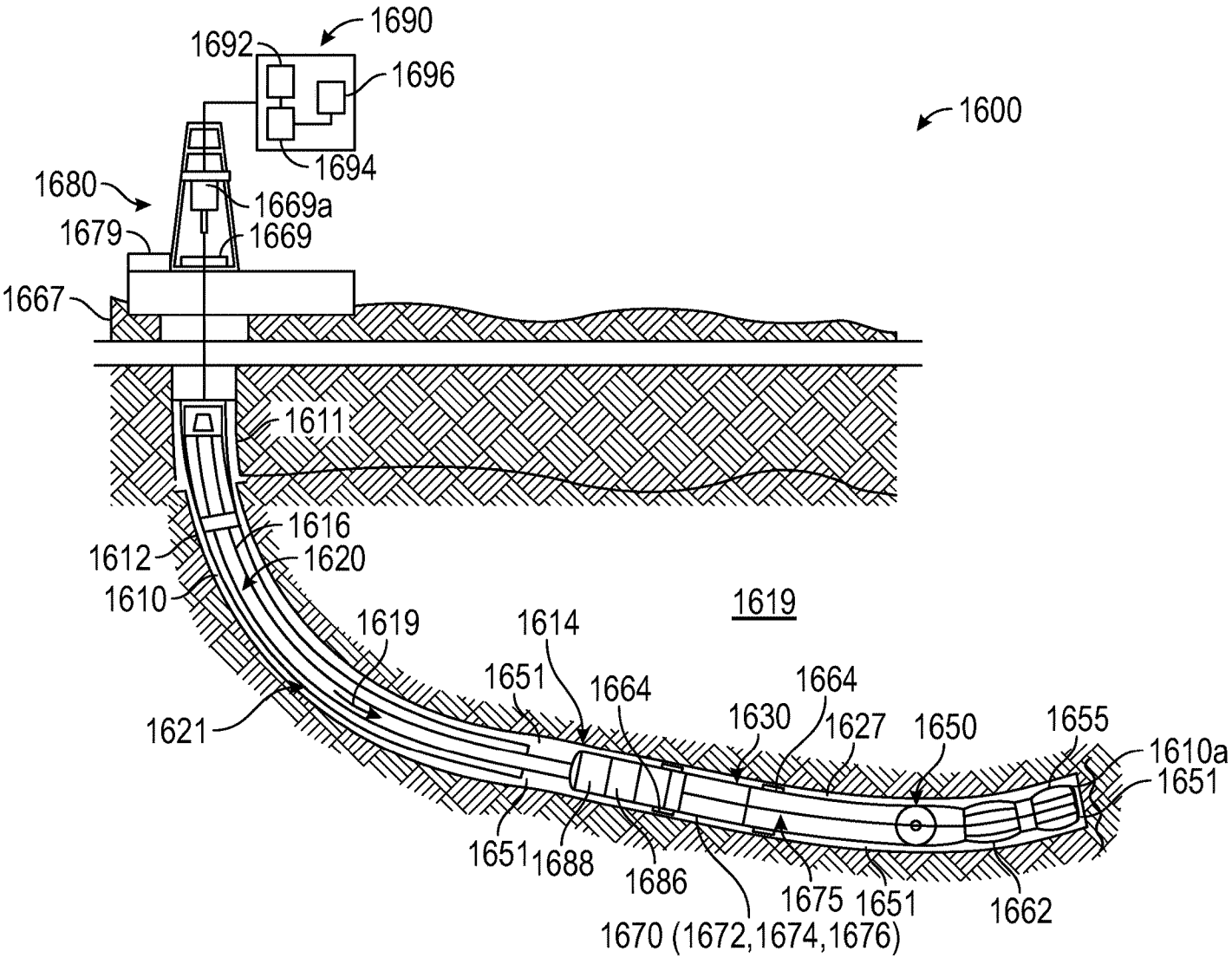
FIG. 16 shows an exemplary drilling system with a drill string conveyed in a wellbore that includes a drilling assembly with a deflection device made according an embodiment of this disclosure.

FIG. 16 is a schematic diagram of an exemplary drilling system 1600 that may utilize a drilling assembly 1630 that includes a deflection device 1650 described in reference to FIGS. 2-12 for drilling straight and deviated wellbores. The drilling system 1600 is shown to include a wellbore 1610 being formed in a formation 1619 that includes an upper wellbore section 1611 with a casing 1612 installed therein and a lower wellbore section 1614 being drilled with a drill string 1620. The drill string 1620 includes a tubular member 1616 that carries a drilling assembly 1630 at its bottom end. The tubular member 1616 may be a drill pipe made up by joining pipe sections, a coiled tubing string, or a combination thereof. The drilling assembly 1630 is shown connected to a disintegrating device, such as a drill bit 1655, attached to its bottom end. The drilling assembly 1630 includes a number of devices, tools and sensors for providing information relating to various parameters of the formation 1619, drilling assembly 1630 and the drilling operations. The drilling assembly 1630 includes a deflection device 1650 made according to an embodiment described in reference to FIGS. 2-15. In FIG. 16, the drill string 1630 is shown conveyed into the wellbore 1610 from an exemplary rig 1680 at the surface 1667. The exemplary rig 1680 is shown as a land rig for ease of explanation. The apparatus and methods disclosed herein may also be utilized with offshore rigs. A rotary table 1669 or a top drive 1669*a* coupled to the drill string 1620 may be utilized to rotate the drill string 1620 and thus the drilling assembly 1630. A control unit 1690 (also referred to as a "controller" or a "surface controller"), which may be a computer-based system, at the surface 1667 may be utilized for receiving and processing data received from sensors in the drilling assembly 1630 and for controlling s drilling operations of the various devices and sensors in the drilling assembly 1630. The surface controller 1690 may include a processor 1692, a data storage device (or a computer-readable medium) 1694 for storing data and computer programs 1696 accessible to the processor 1692 for determining various parameters of interest during drilling of the wellbore 1610 and for controlling selected operations of the various devices and tools in the drilling assembly 1630 and those for drilling of the wellbore 1610. The data storage device 1694 may be any suitable device, including, but not limited to, a read-only memory (ROM), a random-access memory (RAM), a flash memory, a magnetic tape, a hard disc and an optical disk. To drill wellbore 1610, a drilling fluid 1679 is pumped under pressure into the tubular member 1616, which fluid passes through the drilling assembly 1630 and discharges at the bottom 1610*a* of the drill bit 1655. The drill bit 1655 disintegrates the formation rock into cuttings 1651. The drilling fluid 1679 returns to the surface 1667 along with the cuttings 1651 via the annular space (also referred as the "annulus") 1627 between the drill string 1620 and the wellbore 1610.

Still referring to FIG. 16, the drilling assembly 1630 may further include one or more downhole sensors (also referred to as the measurement-while-drilling (MWD) sensors, logging-while-drilling (LWD) sensors or tools, and sensors described in reference to FIGS. 13-15, collectively referred to as downhole devices and designated by numeral 1675, and at least one control unit or controller 1670 for processing data received from the downhole devices 1675. The downhole devices 1675 include a variety of sensors that provide measurements or information relating to the direction, position, and/or orientation of the drilling assembly 1630 and/or the drill bit 1655 in real time. Such sensors include, but are not limited to, accelerometers, magnetometers, gyroscopes, depth measurement sensors, rate of penetration measurement devices. Devices 1675 also include sensors that provide information about the drill string behavior and the drilling operations, including, but not limited to, sensors that provide information about vibration, whirl, stick-slip, rate of penetration of the drill bit into the formation, weight-on-bit, torque, bending, whirl, flow rate, temperature and pressure. The devices 1675 further may include tools or devices that provide measurement or information about properties of rocks, gas, fluids, or any combination thereof in the formation 1619, including, but not limited to, a resistivity tool, an acoustic tool, a gamma ray tool, a nuclear tool, a sampling or testing tool, a coring tool, and a nuclear magnetic resonance tool. The drilling assembly 1630 also includes a power generation device 1686 for providing electrical energy to the various downhole devices 1675 and a telemetry system or unit 1688, which may utilize any suitable telemetry technique, including, but not limited to, mud pulse telemetry, electromagnetic telemetry, acoustic telemetry and wired pipe. Such telemetry techniques are known in the art and are thus not described herein in detail. Drilling assembly 1630, as mentioned above, further includes a deflection device (also referred to as a steering unit or device) 1650 that enables an operator to steer the drill bit 1655 in desired directions to drill deviated wellbores. Stabilizers, such as stabilizers 1662 and 1664 are provided along the steering section 1650 to stabilize the section containing the deflection device 1650 (also referred to as the steering section) and the rest of the drilling assembly 1630. The downhole controller 1670 may include a processor 1672, such as a microprocessor, a data storage device 1674 and a program 1676 accessible to the processor 1672. In aspects, the controller 1670 receives measurements from the various sensors during drilling and may partially or completely process such signals to determine one or more parameters of interest and cause the telemetry system 1688 to transmit some or all such information to the surface controller 1690. In aspects, the controller 1670 may determine the location and orientation of the drilling assembly or the drill bit and send such information to the surface. Alternatively, or in addition thereto, the controller 1690 at the surface determines such parameters from data received from the drilling assembly. An operator at the surface, controller 1670 and/or controller 1690 may orient (direction and tilt) the drilling assembly along desired directions to drill deviated wellbore sections in response to such determined or computed directional parameters. The drilling system 1600, in various aspects, allows an operator to orient the defection device in any desired direction by orienting the drilling assembly based on orientation measurement (for instance relative to north, relative to high side, etc.) that are determined at the surface from downhole measurements described earlier to drill curved and straight sections along desired well paths, monitor drilling direction, and continually adjust orientation as desired in response to the various parameters sensor determined from the sensors described herein and to adjust the drilling parameters to mitigate damage to the components of the drilling assembly. Such actions and adjustments may be done automatically by the controllers in the system or by input from an operator or semi-manually.

Thus, in certain aspects, the deflection device includes one or more sensors that provide measurements relating to directional drilling parameters or the status of the deflection device, such as an angle or angle rate, a distance or distance rate, both relating to the tilt or tilt rate. Such a sensor may include, but not limited to, a bending sensor and an electromagnetic sensor. The electromagnetic sensor translates the angle change or the distance change that is related to the tilt change into a voltage using the induction law or a capacity change. Either the same sensor or another sensor may measure drilling dynamic parameters, such as acceleration, weight on bit, bending, torque, RPM. The deflection device may also include formation evaluation sensors that are used to make geosteering decisions, either via communication to the surface or automatically via a downhole controller. Formation evaluation sensors, such as resistivity, acoustic, nuclear magnetic resonance (NMR), nuclear, etc. may be used to identify downhole formation features, including geological boundaries.

In certain other aspects, the drilling assemblies described herein include a deflection device that: (1) provides a tilt when the drilling assembly is not rotated and the drill bit is rotated by a downhole drive, such as a mud motor, to allow drilling of curved or articulated borehole sections; and (2) the tilt straightens when the drilling assembly is rotated to allow drilling of straight borehole sections. In one non-limiting embodiment, a mechanical force application device may be provided to initiate the tilt. In another non-limiting embodiment, a hydraulic device may be provided to initiate the tilt. A dampening device may be provided to aid in maintaining the tilt straight when the drilling assembly is rotated. A dampening device may also be provided to support the articulated position of the drilling assembly when rapid forces are exerted onto the tilt such as during tool face fluctuations. Additionally, a restrictor may be provided to reduce or control the rate of the tilt. Thus, in various aspects, the drilling assembly automatically articulates into a tilted or hinged position when the drilling assembly is not rotated and automatically attains a straight or substantially straight position when the drilling assembly is rotated. Sensors provide information about the direction (position and orientation) of the lower drilling assembly in the wellbore, which information is used to orient the lower section of the drilling assembly along a desired drilling direction. A permanent predetermined tilt may be provided to aid the tilting of the lower section when the drilling assembly is rotationally stationary. End stops are provided in the deflection device that define the minimum and maximum tilt of the lower section relative to the upper section of the drilling assembly. A variety of sensors in the drilling assembly, including those in or associated with the deflection device, are used to drill wellbores along desired well paths and to take corrective actions to mitigate damage to the components of the drilling assembly. For the purpose of this disclosure, substantially rotationally stationary generally means the drilling assembly is not rotated by rotating the drill string from the surface. The phrase "substantially rotationally stationary" and the term "stationary" are considered equivalent. Also, a "straight" section is intended to include a "substantially straight" section.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to".

The invention claimed is:

1. A drilling assembly for drilling a wellbore, comprising:

a housing having an upper section and a lower section separate from the upper section;

a downhole drive for rotating a drill bit relative to a drill pipe;

the housing comprising a pivot member that couples the upper section of the housing to the lower section of the housing, wherein the lower section of the housing tilts relative to the upper section of the housing about the pivot member when the drill pipe is rotationally stationary to allow drilling of a curved section of the wellbore, and wherein rotating the drill pipe causes a reduction of the tilt between the upper section and the lower section to allow drilling of a straighter section of the wellbore;

wherein the pivot member comprises a first pin through a wall of the housing and a second pin through the wall of the housing; and a tilt sensor that provides measurements relating to the tilt between the upper section and the lower section.

2. The drilling assembly of claim 1, wherein the tilt sensor is selected from a group consisting of: an angular position sensor; a distance sensor; a position sensor; a rotary encoder sensor; a Hall Effect sensor; a magnetic marker; a capacitive sensor; and an inductive sensor.

3. The drilling assembly of claim 1, further comprising a directional sensor that provides measurements relating to a direction of the drilling assembly.

4. The drilling assembly of claim 1 further comprising a force sensor that provides measurements relating to force applied to at least one of the lower section and the upper section.

5. The drilling assembly of claim 4, wherein the force sensor is positioned at an end stop of the drilling assembly that defines a limit of the tilt of the lower section relative to the upper section.

6. The drilling assembly of claim 1, further comprising a drilling parameter sensor that provides measurements relating to a drilling parameter.

7. The drilling assembly of claim 6, wherein the drilling parameter is selected from a group consisting of: vibration; whirl; weight-on-bit; bending moment; pressure; and torque.

8. The drilling assembly of claim 1 further comprising a processor that process the measurements from the tilt sensor and transmits information relating thereto to a receiver.

9. The drilling assembly of claim 1 further comprising:

a device that harvests electrical energy due to motion of one or more elements of the drilling assembly, at least some of the harvested electrical energy for use by the tilt sensor.

10. The drilling assembly of claim 1, wherein the pivot member is a pivotal connection and wherein the tilt sensor provides measurements relating to a tilt angle of the lower section relative to a reference.

11. The drilling assembly of claim 10, wherein the reference is one of: a location on the pivot member; a predefined axis relating to the drilling assembly; and an end stop.

12. The drilling assembly of claim 1, wherein the drilling assembly includes an end stop and wherein the tilt sensor provides measurements relating to one of: distance of a moving member from the end stop; and distance traveled by a moving member toward the end stop from a reference location.

13. The drilling assembly of claim 1, wherein the measurements relating to the tilt between the upper section and the lower section are measured in contact with the pivot member.

14. The drilling assembly of claim 1, wherein the measurements relating to the tilt comprise at least one of the tilt, a tilt rate, an acceleration, a bend, a torque, a force, and a weight.

15. The drilling assembly of claim 14, wherein the tilt or the tilt rate is derived from at least one of an angle measurement, an angle rate measurement, a distance measurement, a distance rate measurement, a position measurement.

16. A method of drilling a wellbore, comprising:

conveying a drilling assembly in the wellbore by a drill pipe from a surface location, the drilling assembly including:

a housing having an upper section and a lower section separate from the upper section;

a downhole drive for rotating a drill bit relative to the drill pipe;

the housing comprising a pivot member that couples the upper section of the housing to the lower section of the housing, wherein the lower section of the housing tilts relative to the upper section of the housing about the pivot member when the drill pipe is rotationally stationary to allow drilling of a curved section of the wellbore, and wherein rotating the drill pipe reduces the tilt between the upper section and the lower section to allow drilling of a straighter section of the wellbore;

wherein the pivot member comprises a first pin through a wall of the housing and a second pin through the wall of the housing; and a tilt sensor that provides measurements relating to the tilt;

drilling a straight section of the wellbore by rotating the drill pipe from the surface location;

causing the drill pipe to become at least rotationally stationary;

determining a parameter of interest relating to the tilt; and drilling the curved section of the wellbore by the downhole drive in the drilling assembly in response to the determined parameter of interest relating to the tilt.

17. The method of claim 16, wherein the tilt sensor is selected from a group consisting of: an angular position sensor; a distance sensor; a position sensor; a rotary encoder sensor; a Hall Effect sensor; a magnetic marker; a capacitive sensor; and an inductive sensor.

18. The method of claim 16, further comprising determining a directional parameter during drilling of the wellbore and adjusting a drilling direction in response thereto.

19. The method of claim 16 further comprising determining a force applied to at least one of the upper section and the lower section.

20. The method of claim 16, further comprising determining a drilling parameter during drilling of the wellbore and taking a corrective action in response to the determined drilling parameter.

21. The method of claim 20, wherein the drilling parameter is selected from a group consisting of: vibration; whirl; weight-on-bit; bending moment; pressure; and torque.

22. The method of claim 16 further comprising using a processor to process the measurements from the tilt sensor and to transmits information relating thereto to a receiver.

23. The method of claim 16 further comprising:

generating electrical energy using a device due to motion of one or more elements of the drilling assembly; and using the generated electrical energy to power the tilt sensor.

24. The method of claim 16, wherein the pivot member is a pivotal connection and wherein the tilt sensor provides measurements relating to a tilt angle of the lower section relative to a reference.

25. The method of claim 16, wherein the drilling assembly includes an end stop and wherein the tilt sensor provides measurements relating to one of: distance of a moving member from the end stop; and distance traveled by a moving member toward the end stop from a reference location.

26. The method of claim 16, wherein the measurements relating to the tilt comprise at least one of the tilt, a tilt rate, an acceleration, a bend, a torque, a force, and a weight.

27. The method of claim 26, wherein the tilt or the tilt rate is derived from at least one of an angle measurement, an angle rate measurement, a distance measurement, a distance rate measurement, a position measurement.

28. The drilling assembly of claim 1, further comprising a shaft, wherein the shaft is coupled to the downhole drive and the drill bit and is disposed in the housing; and a bearing section in the lower section that rotatably couples the shaft to the lower section;

wherein the shaft is disposed and configured to be rotated by the drive within the upper section, the lower section, the bearing section, and the pivot member.

29. The method of claim 16, further comprising a shaft, wherein the shaft is coupled to the downhole drive and the drill bit and is disposed in the housing; and a bearing section in the lower section that rotatably couples the shaft to the lower section;

wherein the shaft is disposed and configured to be rotated by the drive within the upper section, the lower section, the bearing section, and the pivot member.

* * * * *